US007188929B2

(12) United States Patent
Lofthus

(10) Patent No.: US 7,188,929 B2
(45) Date of Patent: Mar. 13, 2007

(54) PARALLEL PRINTING ARCHITECTURE WITH CONTAINERIZED IMAGE MARKING ENGINES

(75) Inventor: Robert M. Lofthus, Webster, NY (US)

(73) Assignee: Xerox Corporation, Stamford, CT (US)

( * ) Notice: Subject to any disclaimer, the term of this patent is extended or adjusted under 35 U.S.C. 154(b) by 326 days.

(21) Appl. No.: 10/917,768

(22) Filed: Aug. 13, 2004

(65) Prior Publication Data

US 2006/0033771 A1 Feb. 16, 2006

(51) Int. Cl.
*B41J 2/145* (2006.01)
*B41J 2/15* (2006.01)

(52) U.S. Cl. ..... 347/40; 347/101; 347/104

(58) Field of Classification Search ..... None
See application file for complete search history.

(56) References Cited

U.S. PATENT DOCUMENTS 4,579,446 A 4/1986 Fujino et al.
4,587,532 A 5/1986 Asano
4,745,490 A * 5/1988 Shimizu et al. ..... 358/300
4,836,119 A 6/1989 Siraco et al.
5,004,222 A 4/1991 Dobashi
5,080,340 A 1/1992 Hacknauer et al.
5,095,342 A 3/1992 Farrell et al.
5,150,167 A * 9/1992 Gonda et al. ..... 399/16
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,548,375 A * 8/1996 Mitsuya et al. ..... 399/9
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.
5,884,910 A 3/1999 Mandel
5,995,721 A 11/1999 Rourke et al.
6,059,284 A 5/2000 Wolf et al.
6,125,248 A 9/2000 Moser (Continued)

OTHER PUBLICATIONS

Morgan, P. F., "Intergration of Black Only and Color Printers", Xerox Disclosure Journal, vol. 16, No. 6, Nov./Dec. 1991, pp. 381-383.

(Continued)

*Primary Examiner*—Thinh Nguyen
(74) *Attorney, Agent, or Firm*—Fay Sharpe LLP; Eugene Palazzo

(57) ABSTRACT

An integrated printing system is provided and includes at least two image marking engines and at least one media feeder module. The printing system further includes a first forward generally horizontal interface media transport between the at least two image marking engines and the at least one feeder module for transporting media from the at least one media feeder module to at least one of the at least two image marking engines.

37 Claims, 1 Drawing Sheet

U.S. PATENT DOCUMENTS 6,185,406 B1 * 2/2001 Ueda ..... 399/402
6,241,242 B1 6/2001 Munro
6,269,237 B1 * 7/2001 Olbrich et al. ..... 399/401
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,819,906 B1 11/2004 Herrmann et al.
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/097,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/120/589, filed May 3, 2005, Contino.
U.S. Appl. No. 11/102,332, filed Apr. 8, 2005, Hindi et al.

* cited by examiner

PARALLEL PRINTING ARCHITECTURE WITH CONTAINERIZED IMAGE MARKING ENGINES

BACKGROUND

The present exemplary embodiment relates to a plurality of image marking engines or image recording apparatuses, and media feeder modules, providing a multifunctional and expandable printing system. It finds particular application in conjunction with integrated printing modules consisting of several marking engines, each having the same or different printing capabilities, and will be described with particular reference thereto. However, it is to be appreciated that the present exemplary embodiment is also amenable to other like applications.

Various apparatuses for recording images on sheets have heretofore been put into practical use. For example, there are copying apparatuses of the type in which the images of originals are recorded on sheets through a photosensitive medium or the like, and printers in which image information transformed into an electrical signal is reproduced as an image on a sheet by an impact system (the type system, the wire dot system or the like) or a non-impact system (the thermosensitive system, the ink jet system, the laser beam system or the like).

The marking engine of an electronic reprographic printing system is frequently an electrophotographic printing machine. In such a machine, a photoconductive belt is charged to a substantially uniform potential to sensitize the belt surface. The charged portion of the belt is thereafter selectively exposed. Exposure of the charged photoconductive belt or member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal to the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images is transferred thereto and then to an output catch tray for subsequent removal. With regard to multi-color printing, as one example, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

Additionally, it is common practice to record images not only on one surface of the sheet, but also on both surfaces of a sheet. Copying or printing on both sides of a sheet decreases the number of sheets used from the viewpoint of saving of resources or filing space. In this regard as well, a system has been put into practical use whereby sheets having images recorded on a first surface thereof are once accumulated and after the recording on the first surface is completed, the accumulated sheets are then fed and images are recorded on a second surface thereof. However, this system is efficient when many sheets having a record of the same content are to be prepared, but is very inefficient when many sheets having different records on both surfaces thereof are to be prepared. That is, when pages 1, 2, 3, 4, . . . are to be prepared, odd pages, i.e. pages 1, 3, 5, . . . , must first be recorded on the first surface of the respective sheets, and then these sheets must be fed again and even pages 2, 4, 6, . . . must be recorded on the second surface of the respective sheets. If, during the second feeding, multiplex feeding or jam of sheets should occur, the combination of the front and back pages may become mixed, thereby necessitating recording be done over again from the beginning. To avoid this, recording may be effected on each sheet in such a manner that the front and back surfaces of each sheet provide the front and back pages, respectively, but this takes time for the refeeding of sheets and the efficiency is reduced. Also, in the prior art methods, the conveyance route of sheets has been complicated and further, the conveyance route has unavoidably involved the step of reversing sheets, and this has led to extremely low reliability of sheet conveyance.

Also, there exist further requirements to record two types of information on one surface of a sheet in superposed relationship. Particularly, recently, coloring has advanced in various fields and there is also a desire to mix, for example, color print with black print on one surface of a sheet. As a simple method for effecting a superposed relationship, there exists systems whereby recording is once effected in black, whereafter the developing device in the apparatus is changed from a black one to a color one, and recording is again effected on the same surface. This system requires an increase in time and labor.

Where two types of information, i.e. multi-pass printing, are to be recorded on one surface of the same sheet in superposed relationship, sufficient care must be taken of the image position accuracy, otherwise the resultant copy may become very unsightly due to image misregistration or deviation from a predetermined image recording frame.

In recent years, the demand for even higher productivity and speed has been required of these image recording apparatuses. However, the respective systems have their own media feed and image processing speed limits and if an attempt is made to provide higher speeds, numerous problems will occur and/or larger and more bulky apparatuses must be used to meet the higher speed demands. The larger and bulkier apparatuses, i.e. high speed printers, typically represent a very expensive and uneconomical apparatus. The expense of these apparatuses along with their inherent complexity can only be justified by the small percentage of extremely high volume printing customers.

U.S. Pat. Nos. 4,591,884; 5,208,640; and 5,041,866 are incorporated by reference as background information.

BRIEF DESCRIPTION

In accordance with one aspect of the present exemplary embodiment, a new and improved integrated printing system is provided. In one embodiment, the printing system includes at least two image marking engines and at least one media feeder module. The printing system further includes a first forward generally horizontal interface media transport between the at least two image marking engines and the at least one feeder module for transporting media from the at least one media feeder module to at least one of the at least two image marking engines.

According to another embodiment, an integrated printing system is provided including at least two image marking engines, an input module, an output module, and a media feeder module. The printing system further includes at least one forward generally horizontal interface media transport for circulating media from the input module to the at least two image marking engines. The system further provides at least one return generally horizontal interface media transport for circulating the media from the output module to the media feeder module.

According to still another embodiment, a method for printing media adapted for a plurality of image marking engines is provided. The method comprises: providing at least two generally vertically aligned image marking engines; providing at least two generally horizontally aligned image marking engines; providing at least one media feeder module; and, circulating media from the at least one media feeder module to an input module for distribution to the generally vertically aligned image marking engines and the generally horizontally aligned image marking engines by way of at least one forward generally horizontal media transport and at least one return generally horizontal media transport.

DETAILED DESCRIPTION

Figure 1:
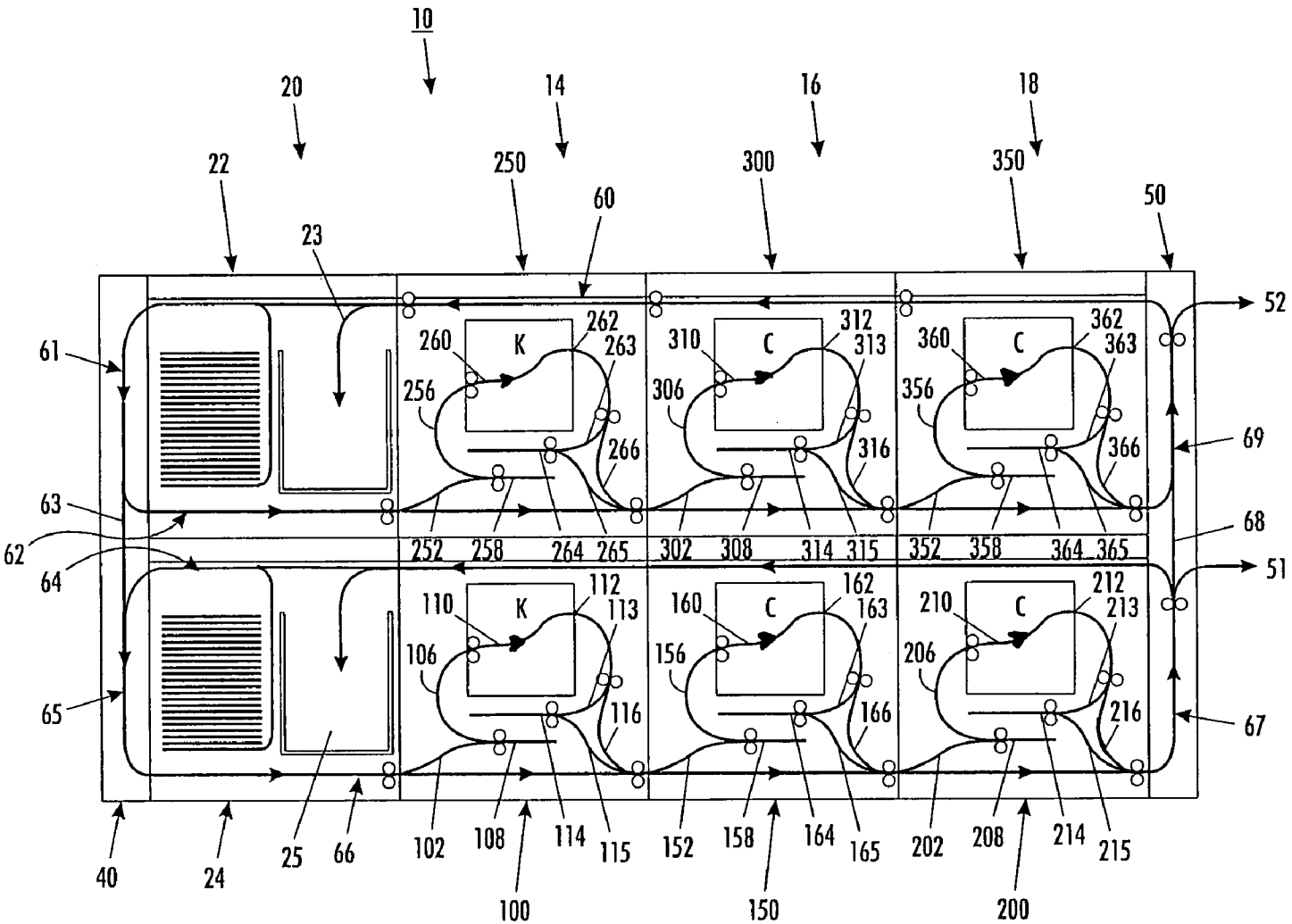
FIG. 1 is a sectional view showing an arrangement of image marking engines and media feeder modules.

While the present printing apparatus and method will hereinafter be described in connection with exemplary embodiments, it will be understood that it is not intended to limit the embodiments. On the contrary, it is intended to cover all alternatives, modifications and equivalents as may be included within the spirit and scope of the embodiments as defined by the appended claims.

The embodiments, to be described below, consist of a plurality of Image Marking Engines (IME) and feeder modules. The IMEs can be, for example, any type of ink-jet printer, a xerographic printer, a thermal head printer that is used in conjunction with heat sensitive paper, or any other apparatus used to mark an image on a substrate. The IMEs can be, for example, black only (monochrome) and/or color printers. Examples of different varieties of black and color printers are shown in FIG. 1, but other varieties, types, alternatives, quantities, and combinations can be used within the scope of exemplary embodiments. It is to be appreciated that, each of the IMEs can include an input/output interface, a memory, a marking cartridge platform, a marking driver, a function switch, a controller and a self-diagnostic unit, all of which can be interconnected by a data/control bus. Each of the IMEs can have a different processing speed capability. The feeder modules can include "garbage cans" or discard areas (paths) to be described hereinafter.

Each marking engine can be connected to a data source over a signal line or link. The data source provides data to be output by marking a receiving medium. In general, the data source can be any of a number of different sources, such as a scanner, a digital copier, a facsimile device that is suitable for generating electronic image data, or a device suitable for storing and/or transmitting the electronic image data, such as a client or server of a network, or the internet, and especially the worldwide web. The data source may also be a data carrier such as a magnetic storage disk, CD ROM, or the like, that contains data to be output by marking. Thus, the data source can be any known or later developed source that is capable of providing scanned and/or synthetic data to each of the marking engines.

The link can be any known or later developed device or system for connecting the image data source to the marking engine, including a direct cable connection, a public switched telephone network, a wireless transmission channel, a connection over a wide area network or a local area network, a connection over an intranet, a connection over the internet, or a connection over any other distributed processing network or system. In general, the link can be any known or later developed connection system or structure usable to connect the data source to the marking engine. Further, it should be appreciated that the data source may be connected to the marking engine directly.

As shown in FIG. 1 and to be described hereinafter, multiple marking engines are shown tightly coupled to or integrated with one another in one illustrative combination thereby enabling high speed printing and low run costs, with a high level of up time and system redundancy. The marking engines are supplied with media by, for example, two integrated feeder modules.

Referring to FIG. 1, a printing system 10 having a modular architecture is shown which employs a vertical frame structure that can hold a plurality of marking engines and feeder modules. The printing system provides horizontal media paths or transport highways. The modular architecture can alternatively include a separate frame structure around each marking engine and feeder module and/or transport highway. The frame structure contains features to allow both horizontal and vertical docking of the marking engines and feeder modules. The frame structure includes horizontal and vertical walls compatible with other marking engines and feeder modules. The image marking engines and feeder modules can be cascaded together with any number of other marking engines to generate higher speed configurations. It is to be appreciated that each marking engine and/or feeder module can be disconnected (i.e. for repair) from the printing system while the rest of the system retains its processing capability.

By way of example, the integrated printing system 10 having three vertical image processing towers 14, 16, 18 comprising six IMEs 100, 150, 200, 250, 300, 350 is shown in FIG. 1. The integrated printing system 10, as shown, further includes a paper/media feeding tower portion 20 comprising two feeder modules 22, 24. The system 10 can include a finishing tower (not illustrated) comprising two, for example, paper/media finishing or stacking portions 51, 52. The system 10 further includes a feed or input endcap module 40 and a finisher or output endcap module 50 for media recirculating within, and media exiting from, the system. Between the endcaps 40, 50 are the six contained and integrated image marking engines 100, 150, 200, 250, 300, 350 and the two feeder modules 22, 24. It is to be appreciated that more and other combinations of color and black marking engines, and feeder modules, can be utilized in any number of configurations.

In operation, media exits the feeding tower portion 20 into the input module 40 and then onto a pair of forward horizontal media highways 62, 66 whereby the media enters the integrated marking engines area.

The architecture, described above, enables the use of multiple marking engines within the same system and can provide single pass duplexing and multi-pass printing or processing. Single pass duplexing refers to a system in which side 1 of a sheet is printed on one marking engine, and side 2 is printed on a second marking engine instead of recirculating the sheet back into the first engine. Multi-pass printing refers to a system in which side 1 of a sheet is printed on one marking engine, and the same side 1 is printed on another marking engine.

In the configuration of FIG. 1, it is to be appreciated that single pass duplexing can be accomplished by any two marking engines, for example IMEs 100 and 150, oriented generally horizontally to one another, where the second IME 150 is positioned downstream from the first or originating marking engine 100. Alternatively, single pass duplexing can be accomplished by any pair of marking engines oriented vertically, horizontally, or non-adjacent, to one another, to be explained hereinafter.

Although not illustrated, it is to be appreciated that at intersections along the horizontal highways and at alternative routes entering and exiting the IMEs, switches or dividing members are located and constructed so as to be switchable to allow sheets or media to move along one path or another depending on the desired route to be taken. The switches or dividing members can be electrically switchable between at least a first position and a second position. An enabler for reliable and productive system operation includes a centralized control system that has responsibility for planning and routing sheets, as well as controlling the switch positions, through the modules in order to execute a job stream.

Referring again to FIG. 1, four separate horizontal highways or media paths 60, 62, 64, 66 are displayed along with their respective media passing directions. An upper horizontal return highway 60 moves media from right to left, a central horizontal forward highway 62 moves media from left to right, a central horizontal return highway 64 moves media from right to left, and a lower horizontal forward highway 66 moves media from left to right. The input module 40 positioned to the left of the feeding tower 20 accepts sheets or media from the feeder modules 22, 24 and delivers them to the central forward 62 and lower forward 66 highways. The output module 50 located to the right of the last vertical marking engine tower, i.e. tower 18, receives sheets from the central forward 62 and the lower forward 66 highways and delivers them in sequence to finishing devices 51, 52 or recirculates the media by way of return paths 60, 64. Although the movements of paths 60, 62, 64, 66 generally follow the directions described above, it is to be appreciated that paths 60, 62, 64, 66, or segments thereof, and connecting transport paths, can intermittently reverse to allow for transport path routing changes of selected media. It is to be appreciated that the entire system can be mirror imaged and media moved in opposite directions.

A key capability shown in FIG. 1 is the ability of media to be marked by any first IME and then by any one or more subsequent IME to enable, for example, single pass duplexing and/or multi-pass printing. The elements that enable this capability are the return highways 60, 64, inverter bypasses, and the input and output modules 40, 50. The return highways 60, 64 are connected to, and extend between, input and output modules 40, 50, allowing, for example, media to first be routed to the lower right IME 200, then up to the top of the output module 50, and then back along the upper return highway 60 to the input module 40, and thence to the upper left IME 250. Media can be discarded from paths 60 and 64 by way of discard paths 23 and 25, prior to entering or reentering paths 61 and 65. Media discarded can be purged from the system at the convenience of the operator and without interruption to any current processing jobs.

With reference to one of the marking engines, namely marking engine 100, the media paths will be explained in detail below. The media originating from the feeding tower 22 can enter the input distributor module 40 and travels to the lower horizontal forward highway 66 by way of paths 61, 63 and/or 65. It is to be appreciated that the media alternatively can be routed, or recirculated to highway 66, by way of return highways 60, 64. The media can exit the horizontal highway 66 at highway exit 102. Upon exiting the horizontal highway 66 along path 102, the media travels into a staging portion or input inverter 108. Thereupon, the media enters the processing portion of marking engine 100 via path 106 and is transported through a processing path 110 of the marking engine 100 whereby the media receives an image. Next, the media exits the processing path 110 at point 112 and can take alternate routes therefrom. Namely, the media can enter another staging portion or output inverter 114 or can travel by way of a bypass path 116 of the output inverter 114 directly to the horizontal highway 66 for exiting the IME 100. Media entering output inverter travels by way of path 113 into inverter 114 and exits by way of path 115. Upon exiting IME 100, the media can move by way of paths 66, 67 to return highway 64 (recirculation) or to finisher 51. Alternatively media can move by way of paths 68 and 69 to return highway 60 (recirculation) or can exit to finisher 52. Select routing combinations of highways 60, 61, 62, 63, 64, 65, 66, 67, 68, and 69 enable media to travel from one IME to any other IME.

With reference now to another marking engine, namely marking engine 150, the media paths will be explained in detail below. The media originating from the feeding tower 22, or indirectly from another IME, can enter the input distributor module 40 and travels to the lower horizontal forward highway 66. It is to be appreciated that the media alternatively can be routed, or recirculated, by way of return highways 60, 64. The media can exit the horizontal highway 66 at highway exit 152. Upon exiting the horizontal highway 66 along path 152, the media travels into a staging portion or input inverter 158. The media then enters the processing portion of marking engine 150 via path 156 and is transported through a processing path 160 of the marking engine 150 whereby the media receives an image. Next, the media exits the processing path 160 at point 162 and can take alternate routes therefrom. Namely, the media can enter another staging portion or output inverter 164 or can travel via a bypass path 166 of the output inverter 164 directly to the horizontal highway 66 for exiting the IME 150. Media entering output inverter travels by way of path 163 into inverter 164 and exits by way of path 165. Upon exiting IME 150, the media can move by way of paths 66, 67 to return highway 64 (recirculation) or to finisher 51. Alternatively media can move by way of paths 68 and 69 to return highway 60 (recirculation) or can exit to finisher 52.

With reference now to another marking engine, namely marking engine 200, the media paths will be explained in detail below. The media originating from the feeding tower 22, or indirectly from another IME, can enter the input distributor module 40 and travels to the lower horizontal forward highway 66. It is to be appreciated that the media alternatively can be routed, or recirculated, by way of return highways 60, 64. The media can exit the horizontal highway 66 at highway exit 202. Upon exiting the horizontal highway 66 along path 202, the media travels into a staging portion or input inverter 208. The media then enters the processing portion of marking engine 200 via path 206 and is transported through a processing path 210 of the marking engine 200 whereby the media receives an image. Next, the media exits the processing path 210 at point 212 and can take alternate routes therefrom. Namely, the media can enter another staging portion or output inverter 214 or can travel via a bypass path 216 of the output inverter 214 directly to the horizontal highway 66 for exiting the IME 200. Media entering output inverter travels by way of path 213 into inverter 214 and exits by way of path 215. Upon exiting IME 200, the media can move by way of paths 66, 67 to return highway 64 (recirculation) or to finisher 51. Alternatively, media can move by way of paths 68 and 69 to return highway 60 (recirculation) or can exit to finisher 52.

With reference now to another marking engine, namely marking engine 250, the media paths will be explained in detail below. The media originating from the feeding tower 22 can enter the input distributor module 40 and travels to the central horizontal forward highway 62 by way of path 61. It is to be appreciated that the media alternatively can be routed, or recirculated, by way of return highway 60. The media can exit the horizontal highway 62 at highway exit 252. Upon exiting the horizontal highway 62 along path 252, the media travels into a staging portion or input inverter 258. Thereupon, the media enters the processing portion of marking engine 250 via path 256 and is transported through a processing path 260 of the marking engine 250 whereby the media receives an image. Next, the media exits the processing path 260 at point 262 and can take alternate routes therefrom. Namely, the media can enter another staging portion or output inverter 264 or can travel via a bypass path 266 of the output inverter 264 to the horizontal highway 62 for exiting the IME 250. Media entering output inverter travels by way of path 263 into inverter 264 and exits by way of path 265. Upon exiting IME 250, the media can move by way of paths 62, 69 to return highway 60 (recirculation) or to finisher 52.

With reference now to another marking engine, namely marking engine 300, the media paths will be explained in detail below. The media originating from the feeding tower 22, or indirectly from another IME, can enter the input distributor module 40, and travels to the central horizontal forward highway 62. It is to be appreciated that the media alternatively can be routed, or recirculated, by way of return highway 60. The media can exit the horizontal highway 62 at highway exit 302. Upon exiting the horizontal highway 62 along path 302, the media travels into a staging portion or input inverter 308. Thereupon, the media enters the processing portion of marking engine 300 via path 306 and is transported through a processing path 310 of the marking engine 300 whereby the media receives an image. Next, the media exits the processing path 310 at point 312 and can take alternate routes therefrom. Namely, the media can enter another staging portion or output inverter 314 or can travel via a bypass path 316 of the output inverter 314 to the horizontal highway 62 for exiting the IME 300. Media entering output inverter travels by way of path 313 into inverter 314 and exits by way of path 315. Upon exiting IME 300, the media can move by way of paths 62, 69 to return highway 60 (recirculation) or can exit to finisher 52.

With reference now to another marking engine, namely marking engine 350, the media paths will be explained in detail below. The media originating from the feeding tower 22, or indirectly from another IME, can enter the input distributor module 40, and travels to the central horizontal forward highway 62. It is to be appreciated that the media alternatively can be routed, or recirculated, by way of return highway 60. The media can exit the horizontal highway 62 at highway exit 352. Upon exiting the horizontal highway 62 along path 352, the media travels into a staging portion or input inverter 358. Thereupon, the media enters the processing portion of marking engine 350 via path 356 and is transported through a processing path 360 of the marking engine 350 whereby the media receives an image. Next, the media exits the processing path 360 at point 362 and can take alternate routes therefrom. Namely, the media can enter another staging portion or output inverter 364 or can travel via a bypass path 366 of the output inverter 364 to the horizontal highway 62 for exiting the IME 350. Media entering output inverter travels by way of path 363 into inverter 364 and exits by way of path 365. Upon exiting IME 350, the media can move by way of paths 62, 69 to return highway 60 (recirculation) or can exit to finisher 52.

In FIG. 1, the IMEs and media feeder modules are shown in one exemplary arrangement. Optimal relative locations and number of the IMEs and media feeder modules are dependant upon analysis of customer usage demographics, such as the split between black only versus color processing frequency, and the system processing volume requirements.

As shown in FIG. 1, each of the marking engines can include a pair of inverter subsystems, for example input inverter 108 and output inverter 114. The inverters can serve a function for media entering or exiting a highway; in particular, the inverters invert sheets for single pass duplex printing. It is to be appreciated that each container module paper path can include a bypass path for the input inverter (not illustrated) and/or a bypass path for the output inverter, for example, path 116. In this manner, media moving from one IME to another IME can bypass either inverter to enable single pass duplexing or can bypass both inverters to enable multi-pass printing. It is to be appreciated that media traveling through both an input inverter and an output inverter between one IME and another IME will be subjected to multi-pass printing.

The modular architecture of the printing system described above employs at least two IMEs, and at least two feeder modules, with associated input/output media paths which can be stacked "two up" inside a supporting frame to form a basic "two up" module with two marking engines. The modular architecture can include additional IMEs and feeder modules which can be "ganged" together in which the horizontal highways can be aligned to transport media to/from the marking engines. The system can include additional horizontal highways positioned above, between, and/or below the ganged marking engines. The exit module can merge the sheets from the highways. The exit module can also provide optional inversion and/or multiple output locations. It is to be appreciated that the highways can move media at a faster transport speed than the internal marking engine paper pass.

The modular media path architecture provides for a common interface and highway geometry which allows different marking engines with different internal media paths together in one system. The modular media path includes entrance and exit media paths which allow sheets from one marking engine to be fed to another marking engine, either in an inverted or in a non-inverted (by way of a bypass) orientation.

The modular architecture enables a wide range of marking engines in the same system. As described above, the marking engines can involve a variety of types and processing speeds. The modular architecture can provide redundancy for marking engines and paths. The modular architecture can utilize a single media source on the input side and a single output merging module on the output side. The output merging module can also provide optional inversion and multiple output locations. It is to be appreciated that an advantage of the system is that it can achieve very high productivity, using marking processes in elements that do not have to run at high speeds and marking processes that can continue to run while other marking engines are being serviced. This simplifies many subsystems such as fusing, and allows use of lower priced marking engines. Although not shown, other examples of the modular architecture can include an odd number of marking engines. For example, three marking engines can be configured such that two are aligned vertically and two are aligned horizontally, wherein one of the marking engines is common to both the vertical and horizontal alignment.

The modular architecture enables color and black single pass duplexing, and color and black multi-pass processing, or variations thereof.

The exemplary embodiments have been described with reference to the specific embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. An integrated printing system comprising:

at least two substantially vertically aligned image marking engines;

at least two substantially horizontally aligned image marking engines;

at least one image marking engine common to both said vertically aligned image marking engines and said horizontally aligned image marking engines;

at least one media feeder module; and, a first forward generally horizontal interface media transport between said at least two image marking engines and said at least one feeder module for selectively transporting media to and from said at least one media feeder module to one image marking engine and then selectively to any other image marking engine.

2. The integrated printing system of claim 1, further including another media feeder module.

3. The integrated printing system of claim 2, wherein at least two media feeder modules are generally vertically aligned.

4. The integrated printing system of claim 1, wherein said first forward generally horizontal media transport extends from an input module to an output module for transporting media in a first direction.

5. The integrated printing system of claim 4, further including a second forward generally horizontal interface media transport below said at least two image marking engines and said at least one feeder module, and extending from said input module to said output module for transporting media in said first direction.

6. The integrated printing system of claim 5, further including at least one generally vertical interface media transport extending from said first forward generally horizontal interface media transport to said second forward generally horizontal interface media transport.

7. The integrated printing system of claim 6, further including a first return generally horizontal interface media transport extending from said input module to said output module for transporting media in a second direction.

8. The integrated printing system of claim 7, wherein said first return horizontal transport is positioned above said at least two image marking engines and said at least one feeder module.

9. The integrated printing system of claim 7, further including a second return generally horizontal interface media transport extending from said input module to said output module for transporting media in said second direction.

10. The integrated printing system of claim 9, wherein said second return horizontal transport is positioned between said at least two image marking engines and said at least one feeder module.

11. The integrated printing system of claim 10, wherein each said first return and said second return media transports include a media discard path for discarding selected media from said printing system.

12. The integrated printing system of claim 7, wherein said first direction and said second direction are generally opposite.

13. The integrated printing system of claim 1, further including at least one finishing source for receiving said sheets from said printing system.

14. An integrated printing system comprising:

at least two substantially vertically aligned image marking engines;

at least two substantially horizontally aligned image marking engines;

an input module;

an output module;

a media feeder module;

at least one forward generally horizontal interface media transport for circulating media sheets selectively from said input module to and from a first image marking engine, at least a second image marking engine, and selectively bypassing at least a third image marking engine; and, at least one return generally horizontal interface media transport for circulating said media from said output module to said media feeder module.

15. The integrated printing system of claim 14, wherein said media feeder module includes a media discard path for discarding selected media from said printing system.

16. The integrated printing system of claim 14, wherein said input module connects said at least one forward media transport and said at least one return media transport.

17. The integrated printing system of claim 16, wherein said output module connects said at least one forward media transport and said at least one return media transport.

18. The integrated printing system of claim 14, wherein at least said first image marking engine is non-adjacent to said at least said second image marking engine.

19. The integrated printing system of claim 18, wherein said at least said first image marking engine is a first type and said at least said second image marking engine is a second type.

20. The integrated printing system of claim 18, wherein said at least said first image marking engine and said at least said second image marking engine are of the same type.

21. The integrated printing system of claim 14, wherein each said image marking engine includes a media transport for connecting to said at least one forward generally horizontal interface media transport.

22. A method for printing media adapted for a plurality of image marking engines, the method comprising:

providing at least two generally vertically aligned image marking engines;

providing at least two generally horizontally aligned image marking engines;

providing at least one image marking engine common to both said vertically aligned image marking engines and said horizontally aligned image marking engines;

providing at least one media feeder module; and, circulating media from said at least one media feeder module to an input module for distribution of said media in a selected order to and from said generally vertically aligned image marking engines and said generally horizontally aligned image marking engines by way of at least one forward generally horizontal media transport and at least one return generally horizontal media transport wherein said medial selectively enters and exits any one of said image marking engines and selectively enters any other one of said image marking engines.

23. The method of claim 22, wherein said circulating media further includes transporting said media selectively from one image marking engine to any other image marking engine.

24. The method of claim 23, wherein said one image marking engine and at least another image marking engine are non-adjacent.

25. The method of claim 23, wherein said circulating said media further includes;

providing at least another transport for transporting said media from said one image marking engine to said any other image marking engine.

26. The method of claim 22, wherein said at least one return generally horizontal media transport includes a discard path for removing selected media from said printing system.

27. The method of claim 22, wherein said circulating said media comprises said at least one forward generally horizontal interface media transport for circulating said media in a first direction, and said at least one return generally horizontal interface media transport for circulating said media in a second direction, said first direction and said second direction are generally opposite.

28. The method of claim 22, further comprising recording on said media images according to image data supplied thereto.

29. The method of claim 22, further comprising recording on one side of said media on one image marking engine and recording on another side of said media on another image marking engine.

30. The method of claim 29, wherein said recording on said one side and said another side of said media comprises an additional media transport including at least one inverter for inverting said media.

31. The method of claim 30, wherein said at least one inverter is positioned between said one image marking engine and said another image marking engine.

32. The method of claim 22, further comprising recording on one side of said media on said one image marking engine and recording on same said one side of said media on said another marking engine.

33. The method of claim 22, wherein said at least one inverter is positioned between said at least two generally horizontally aligned image marking engines.

34. The method of claim 22, wherein said at least one forward generally horizontal interface media transport is positioned between said at least two generally vertically aligned image marking engines.

35. The method of claim 34, wherein said at least one forward generally horizontal interface media transport is positioned below said at least two generally vertically aligned image marking engines.

36. The method of claim 34, wherein said at least one return generally horizontal interface media transport is positioned above said at least two generally vertically aligned image marking engines.

37. The method of claim 22, wherein said at least one return generally horizontal interface media transport is positioned between said at least two generally vertically aligned image marking engines.

* * * * *